US009452581B2

(12) United States Patent
Martin et al.

(10) Patent No.: US 9,452,581 B2
(45) Date of Patent: Sep. 27, 2016

(54) PRESS MACHINE

(71) Applicant: VAMCO INTERNATIONAL, INC., Pittsburgh, PA (US)

(72) Inventors: Vaughn H. Martin, Mars, PA (US); Joseph P. Gentile, Longboat Key, FL (US); Bryan P. Gentile, Longboat Key, FL (US)

(73) Assignee: VAMCO INTERNATIONAL, INC., Pittsburgh, PA (US)

( * ) Notice: Subject to any disclaimer, the term of this patent is extended or adjusted under 35 U.S.C. 154(b) by 0 days.

(21) Appl. No.: 14/773,981

(22) PCT Filed: Mar. 12, 2014

(86) PCT No.: PCT/US2014/024063
§ 371 (c)(1),
(2) Date: Sep. 9, 2015

(87) PCT Pub. No.: WO2014/164994
PCT Pub. Date: Oct. 9, 2014

(65) Prior Publication Data

US 2016/0031176 A1 Feb. 4, 2016

Related U.S. Application Data

(60) Provisional application No. 61/777,660, filed on Mar. 12, 2013.

(51) Int. Cl.
*B30B 1/06* (2006.01)
*B30B 1/26* (2006.01)
(Continued)

(52) U.S. Cl.
CPC ..... *B30B 1/268* (2013.01); *B30B 1/06* (2013.01); *B30B 1/26* (2013.01); *B30B 1/266* (2013.01);
(Continued)

(58) Field of Classification Search
CPC ..... B30B 1/06; B30B 1/14; B30B 1/26; B30B 1/266; B30B 1/268; B30B 15/047; B30B 15/0064; B30B 15/044; B30B 15/14; B30B 15/16; B30B 15/28; B21C 51/00; B21D 55/00; B21J 7/46
USPC ..... 100/48, 50, 282, 283, 285, 286; 72/20.1, 21.1, 443, 451
See application file for complete search history.

(56) References Cited

U.S. PATENT DOCUMENTS 2,750,879 A 6/1956 Palfy
3,124,019 A * 3/1964 Chatfield ..... B21J 9/18 100/281
(Continued)

FOREIGN PATENT DOCUMENTS

| | | |
|---|---|---|
| DE | 2806976 | 8/1978 |
| GB | 872308 | 7/1961 |
| JP | 2011177756 | 9/2011 |

OTHER PUBLICATIONS

International Search Report and Written Opinion of PCT/US14/24135 dated Jul. 29, 2014.
(Continued)

*Primary Examiner* — Jimmy T Nguyen
(74) *Attorney, Agent, or Firm* — Cheryl L. Gastineau; Reed Smith LLP

(57) ABSTRACT

A press machine includes a press frame, a crankshaft having an eccentric portion, at least one crankshaft motor connected to the crankshaft, a ram, a linkage type ram drive mechanism operably connected between the ram and the crankshaft, a first motor, with a first rotary position feedback device, a second motor with a second rotary position feedback device. The eccentric portion of the crankshaft is located between first and second ends of the crankshaft.

10 Claims, 11 Drawing Sheets

(51) Int. Cl.
*B30B 15/00* (2006.01)
*B30B 15/04* (2006.01)
*B30B 15/28* (2006.01)

(52) U.S. Cl.
CPC ..... *B30B 15/0064* (2013.01); *B30B 15/044* (2013.01); *B30B 15/047* (2013.01); *B30B 15/28* (2013.01)

(56) References Cited

U.S. PATENT DOCUMENTS 4,013,003 A 3/1977 Finsterwalder et al.
2005/0145117 A1 7/2005 Du et al.
2006/0283229 A1 12/2006 Futamura et al.
2008/0156206 A1* 7/2008 Yoshida ..... B30B 1/14 100/282
2009/0188295 A1 7/2009 Kuboe
2009/0260460 A1* 10/2009 Darr ..... B30B 1/266 74/49
2011/0109257 A1 5/2011 Someya
2011/0126649 A1* 6/2011 Darr ..... B30B 1/266 74/44
2011/0290125 A1* 12/2011 Ito ..... B30B 1/266 100/214
2011/0290126 A1* 12/2011 Ito ..... B30B 15/148 100/280
2013/0008325 A1* 1/2013 Lin ..... B30B 1/14 100/285

OTHER PUBLICATIONS

International Search Report and Written Opinion of PCT/US14/24055 dated Jul. 29, 2014.
International Search Report and Written Opinion of PCT/US14/24063 dated Aug. 5, 2014.

* cited by examiner

SECTION A-A

SECTION B-B

SECTION C-C

PRESS MACHINE

CROSS-REFERENCE TO RELATED APPLICATION

This application is a United States national stage of International Application No. PCT/US2014/024063, filed Mar. 12, 2014, which published as International Publication No. WO 2014/164994, and which claims the benefit under 35 U.S.C. §119(e) of the earlier filing date of U.S. Provisional Patent Application No. 61/777,660 filed on Mar. 12, 2013, which is hereby incorporated by reference.

BACKGROUND

The present invention relates to a notching press machine for punching, stamping, or die cutting so called "notches" in the inner or outer peripheries, or both, of typically circular or annular work pieces, such as electric motor and generator laminations or the like. Many notching presses of differing designs are known in the art.

Many notching presses known in the art are comprised of a "C" shaped press frame, commonly called a "gap frame press", a driven eccentric crankshaft, a linearly guided slide or ram for mounting an upper or punch section of a tool, a linkage type transmission mechanism for transforming the rotating eccentric crankshaft motion into a linear reciprocating motion of the slide or ram, and a mounting location or bed section of the press frame for mounting the stationary lower or die section of a tool. These components cooperate to move the upper or punch section of a tool into and out of engagement with the lower or die section of the tool and the work piece which is positioned there-between. Known gap frame presses typically are driven by a continuously rotating crankshaft drive motor and sometimes a flywheel, a clutch which when engaged drivingly connects the drive motor or flywheel to the crankshaft for rotating the crankshaft, and a brake mechanism for stopping the crankshaft after the clutch has disengaged.

Many notching presses further comprise an indexing mechanism arranged to hold a work piece and for the intermittent rotation of the work piece while the tool is out of engagement with the work piece and to hold the work piece in a proper angular position when the tool is engaged with the work piece to produce the desired final work piece shape.

Many notching presses further comprise a stationary base to which the gap frame press attached and is arranged for sliding in a typically horizontal direction, and in particular in a direction perpendicular to the motion of the press ram, in order to vary the distance between the tool and the indexing mechanism axis of rotation to facilitate the processing of work pieces of varying diameters or for the punching at multiple diameters of a single work piece.

Notching presses are typically capable of accepting exchangeable tools to perform the cutting or stamping of the work piece. Different tools may require different so-called "shut height" settings. Press shut height is the distance, measured in the direction of ram motion, from the end of the ram to which the upper or punch section of the tool is attached to the mounting location or bed section of the press frame to which the lower or die section of the tool is attached when the ram is in the closest or "shut" position. Many notching presses known in the art comprise an adjustment mechanism for changing the press shut height to permit the use of exchangeable tools. Typically the adjustment mechanisms are disadvantageously manually adjusted.

It is desirable for notching presses to operate at relatively high production rates generally measured in "strokes per minute." To achieve maximum production rates, it is desirable to configure a notching press with minimal press stroke length. Press stroke length is the distance marked by the farthest ends of the reciprocating movement of the press ram. Minimizing the stroke length of a notching press ram increases the difficulty of loading and unloading of the work piece between the upper and lower section of the tool. Therefore, it is common for notching presses to comprise a ram lifting mechanism to further move the ram away from the work piece upon completion of all punching operations to be performed on the individual work piece. The finished work piece may be then easily unloaded and a next work piece may be loaded for processing after which the ram lifting mechanism moves the ram to the desired starting position for subsequent crankshaft rotation and stamping operations to proceed. Current known in the art ram lifting apparatus lift the ram in a fixed amount.

As previously described, the notching press tool typically includes two sections: an upper or punch section and the lower or die tool section. Typically, the lower tool section is rigidly mounted to a bolster plate that is rigidly mounted to the press bed. The upper tool section is typically rigidly mounted to the press ram thereby subject to reciprocating and typically vertical, motion into and out of engagement with the lower tool section. Guiding of the press ram is provided to ensure and maintain proper alignment of the upper and lower tool sections. Any deviation in the alignment of the upper tool section with respect to the lower tool section will reduce the cutting accuracy of the tool. Additionally, this deviation may cause damage to the tool. The successful stamping of any work piece is dependent on the ability for the upper tool section and the lower tool section to maintain proper alignment.

The generally "C" shaped press frame of typical notching press, while necessary for the convenient loading and unloading of a work piece, will necessarily bend or deflect due to the high forces generated in the stamping operation. For example, during the time of impact of the press ram and upper tool section onto a work piece, a typical gap frame press will experience an angular deflection and subsequently the crankshaft will be displaced in a direction perpendicular to the line of action of the press ram. Furthermore, in many known such presses, the ram guiding is disadvantageously subject to this deflection of the frame causing miss-alignment of the upper and lower tool sections.

To overcome these and other disadvantages of presses known in the art, a notching press machine is depicted in the enclosed figures.

DETAILED DESCRIPTION

Figure 1:
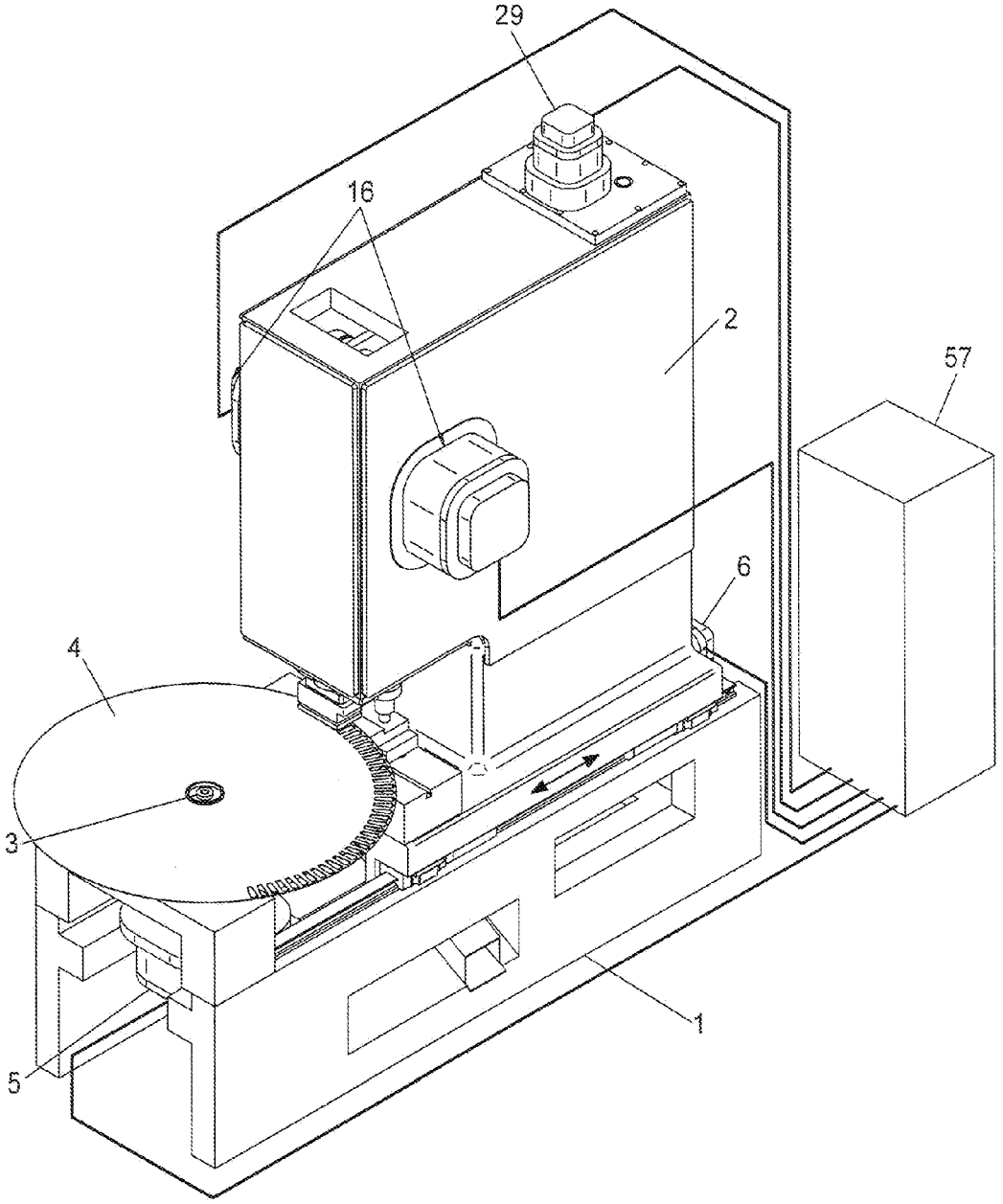
FIG. 1 is an isometric view of the notching press machine according to embodiments of the invention.
Figure 2:
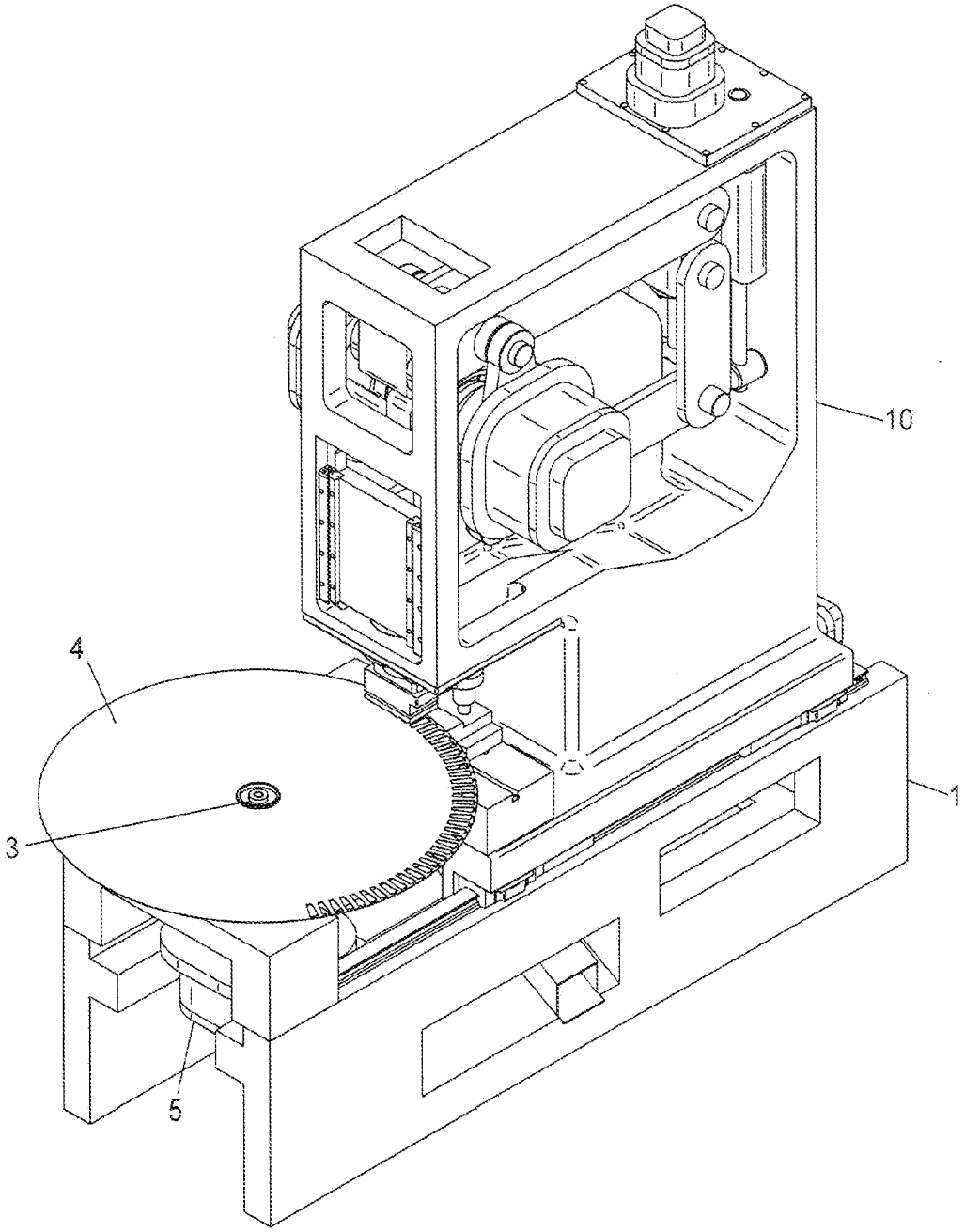
FIG. 2 is an isometric view of the notching press machine with covers removed.

It is to be understood that the invention is not limited in its application to the details of construction and to the arrangements of the components set forth in the following description or illustrated in the drawings and that some embodiments are described by way of reference only. The invention is capable of embodiments in addition to those described and of being practiced and carried out in various ways. Also, it is to be understood that the phraseology and terminology employed herein are for the purpose of description and should not be regarded as limiting With reference to FIGS. 1-11, the notching press machine according to embodiments of the invention includes a stationary base 1, a generally depicted gap frame press 2 mounted to base 1 and arranged for sliding thereon, a generally depicted spindle 3 mounted to base 1 for holding and indexing a work piece 4. Index motor 5 is arranged for rotary movement of spindle 3 and work piece 4.

The notching press machine further comprises a press positioning screw 7 (FIG. 8), rotatable mounted to base 1, a press positioning threaded nut 8 fixedly mounted to a press frame 10, and a press positioning motor 6, fixedly mounted to base 1 and drivingly connected to press positioning screw 7. Press positioning motor 6, screw 7, and nut 8 cooperate to move gap frame press 2 along a line perpendicular to the rotation axis of spindle 3 to adapt the notching press machine for processing of a particular work piece 4. Similarly arranged notching press machines are well known in the art.

To overcome the disadvantages of known notching press machines the notching press machine is further comprised of a crankshaft 13 (FIG. 6) having a first eccentric portion 14 and a second eccentric portion 15. Crankshaft 13 is rotatable supported by press frame 10 and in particular is supported by a first section 11 (FIG. 10) of press frame 10. In the preferred embodiment shown first eccentric portion 14 and second eccentric portion 15 are comprised of two parts symmetrically arranged about midpoint of crankshaft 13. Crankshaft 13 is drivingly connected to a crankshaft drive motor 16 fixedly attached to press frame 10 and preferable is drivingly connected at both ends of crankshaft 13 to two crankshaft drive motors 16 fixedly attached to frame 10. Drive motor or preferable drive motors 16 provide a rotating driving torque for rotation of crankshaft 13. Drive motors 16 are preferably electric servo motors and further include feedback devices 17 to provide crankshaft rotary position information to a control system 57 (FIG. 1). The control system may be a conventional servo control system well known to one skilled in the art. The two crankshaft drive motors 16 are torque reversible and start, drive, and stop crankshaft 13. It is desirable to ensure safe operation of the notching press machine in the case of a component failure to provide redundant monitoring and stopping systems. In normal operation drive motors 16 cooperate to start, maintain, and stop rotation of crankshaft 13 while the control system 57 monitors feedback devices 17 of drive motors 16. The control system is configured to command a stoppage of the first drive motor. The control system is configured to command a stoppage of the second drive motor. The control system is preferably further configured to command a start of the first drive motor. The control system is preferably further configured to command a start of the second drive motor. The control system is preferably further configured to command a rotation speed of the first and second drive motors. The control system is configured to compare the rotary position feedback signals of the feedback devices 17. The control device is configured to command a stoppage of the first drive motor in response to a detection of a difference between the rotary position feedback signal of the first rotary position feedback device and the rotary position feedback signal of the second rotary position feedback device. The control system is also configured to command a stoppage of the second drive motor in response to a detection of a difference between the rotary position feedback signal of the first rotary position feedback device and the rotary position feedback signal of the second rotary position feedback device. In the event of a failure of any component of the system, for example the speed of feedback devices 17 do not match due to a failure of a feedback device 17, the disconnection of a drive motor 16 from crankshaft 13, a breakage of crankshaft 13, or failure of a feedback device 17, the remaining functioning drive motor may be used to safely stop the rotation of crankshaft 13. Thus by providing redundant drive means, namely drive motors 16, with redundant monitoring, namely feedback devices 17, the notching press machine ensures safe operation while eliminating the need for crankshaft clutch and braking devices which are required by notching press machines in the current art.

The notching press machine is further comprised of a ram 40 (FIG. 8) supported by press frame 10 and in particular by second section 12 of press frame 10 and arranged for sliding movement in a linear direction parallel to the rotational axis of indexing spindle 3 and being guided by ram guide(s) 44. Ram 40 fixedly supports an upper tool section 42 which cooperates with a lower tool section 43 which is fixedly attached to press frame 10 and in particular to section 11 of press frame 10 for punching or processing of work piece 4.

The notching press machine further comprises a linkage type ram drive mechanism comprising a main ram drive link 22 (FIG. 11), a ram drive connecting link 20, a secondary ram drive link 24, and pivot pins 21, 23, 25, and 41. Secondary ram drive link 24 is pivotally supported at a first end by pivot pin 25 and is pivotally connected at a second end to a first end of main ram drive link 22 by pivot pin 23. Main ram drive link 22 is pivotally connected at a second end to ram 40 by pivot pin 41. Ram drive connecting link 20 is rotatable supported by the first eccentric portion 14 of crankshaft 13 at a first end. Ram drive connecting link 20 is further pivotally connected at a second end to main ram drive link 22 at a point between the first and second ends of main ram drive link 22. In the preferred embodiment shown, two ram drive connecting links 20 and two first eccentric portions 14 or crankshaft 13 are arranged symmetrically about the midpoint of the gap frame press. It should be noted however that although two ram drive connecting links 20 and two first eccentric portions 14 of crankshaft 13 are shown, this is a only a matter of convenience in the particular embodiment shown and is not necessary.

The notching press machine further comprises a ram adjustment mechanism which allows for quick and easy ram shut height adjustment as well as a ram lifting function. The ram adjustment mechanism is comprised of support member 26 (FIG. 8) supported by press frame 10 and in particular by section 12 of press frame 10 and arranged for movement relative to the press frame in a direction substantially parallel to the line of motion of the ram 40. The ram adjustment mechanism is further comprised of a positioning mechanism for the movement and the positioning of support member 26. Preferably the position mechanism is comprised of a ram adjustment screw 28 which is rotatable supported by frame 10, a ram adjustment threaded nut member 31, fixedly supported in support member 26, and a ram adjustment motor 29 which includes a feedback device 30 and which is drivingly connected to screw 28. The ram adjustment mechanism is pivotally connected to the first end of secondary ram drive link 24 by pivot pin 25. In the preferred embodiment shown two secondary ram drive links 24 and two pivot pins 25 cooperate to perform the same function and are arranged symmetrically about the midpoint of the gap frame press. It should be noted however that although two secondary ram drive links 24 and two pivot pins 25 are shown, this is a only a matter of convenience in the particular embodiment shown and is not necessary.

Figure 3:
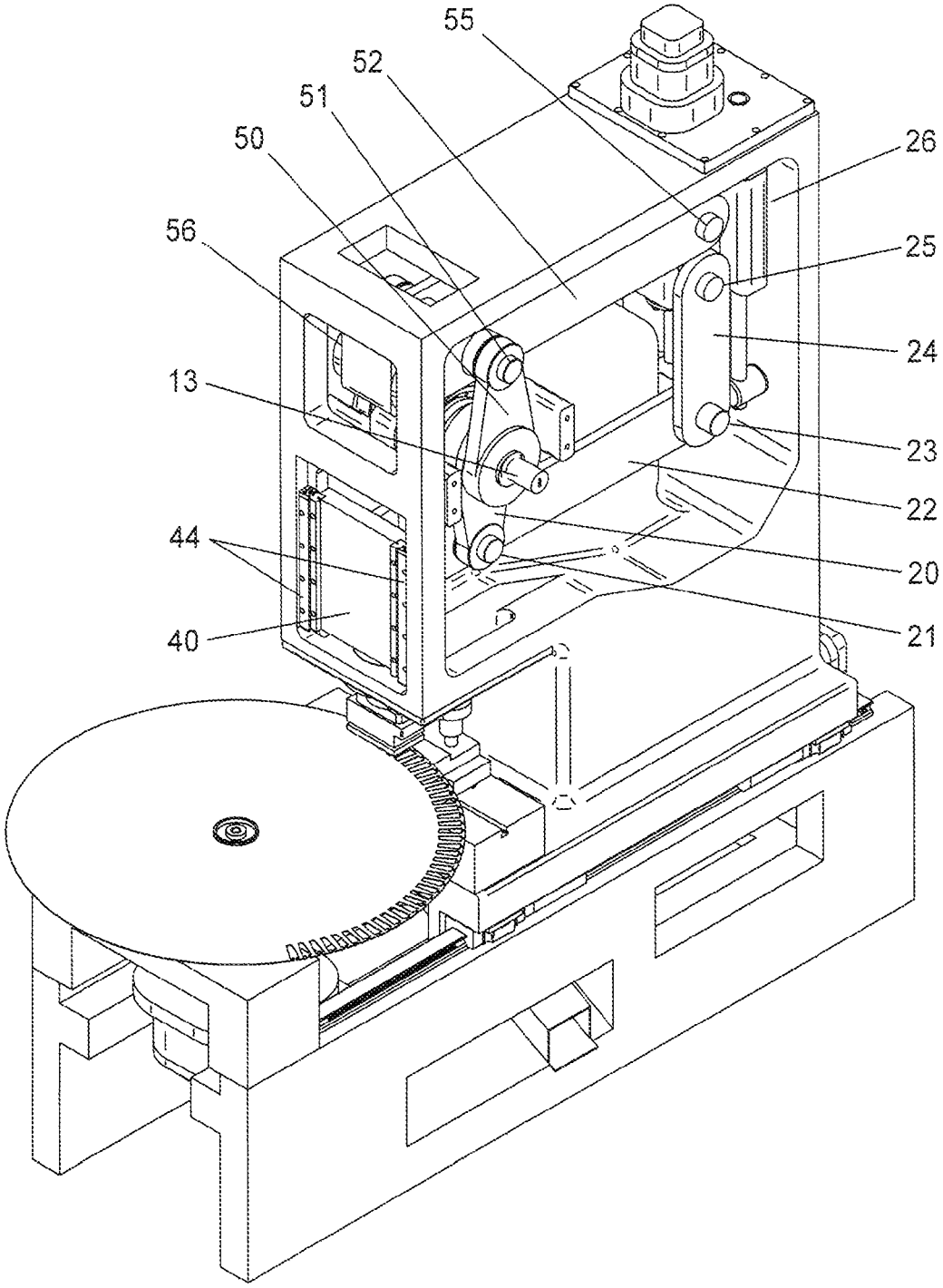
FIG. 3 is an isometric view of the notching press machine with covers and crankshaft motors removed.
Figure 4:
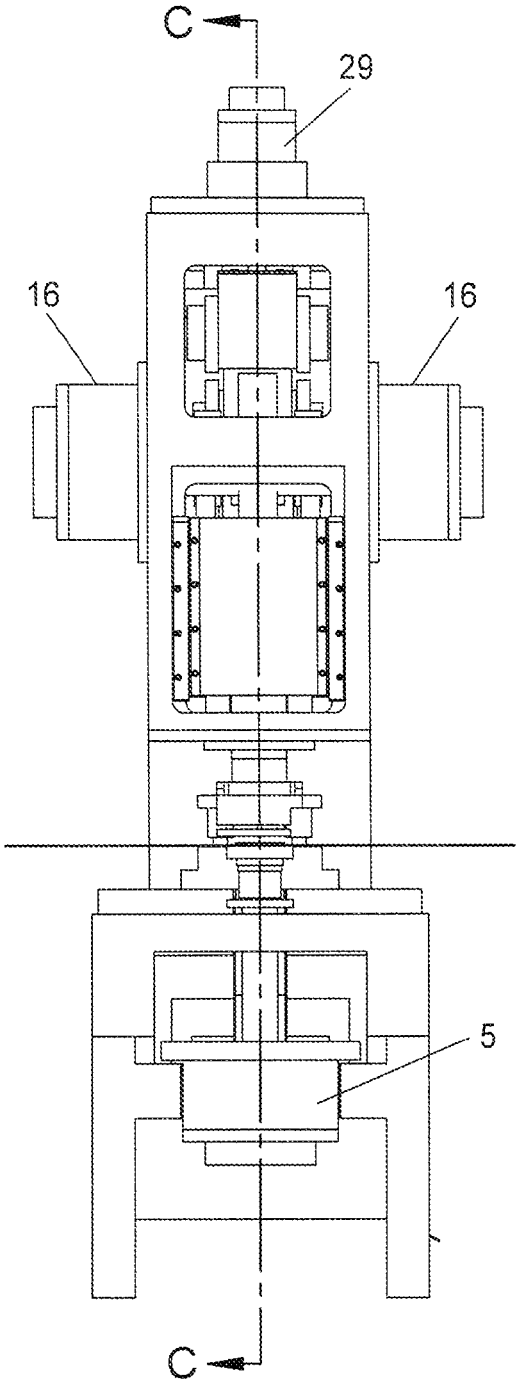
FIG. 4 is a front view of the notching press machine with covers removed.
Figure 5:
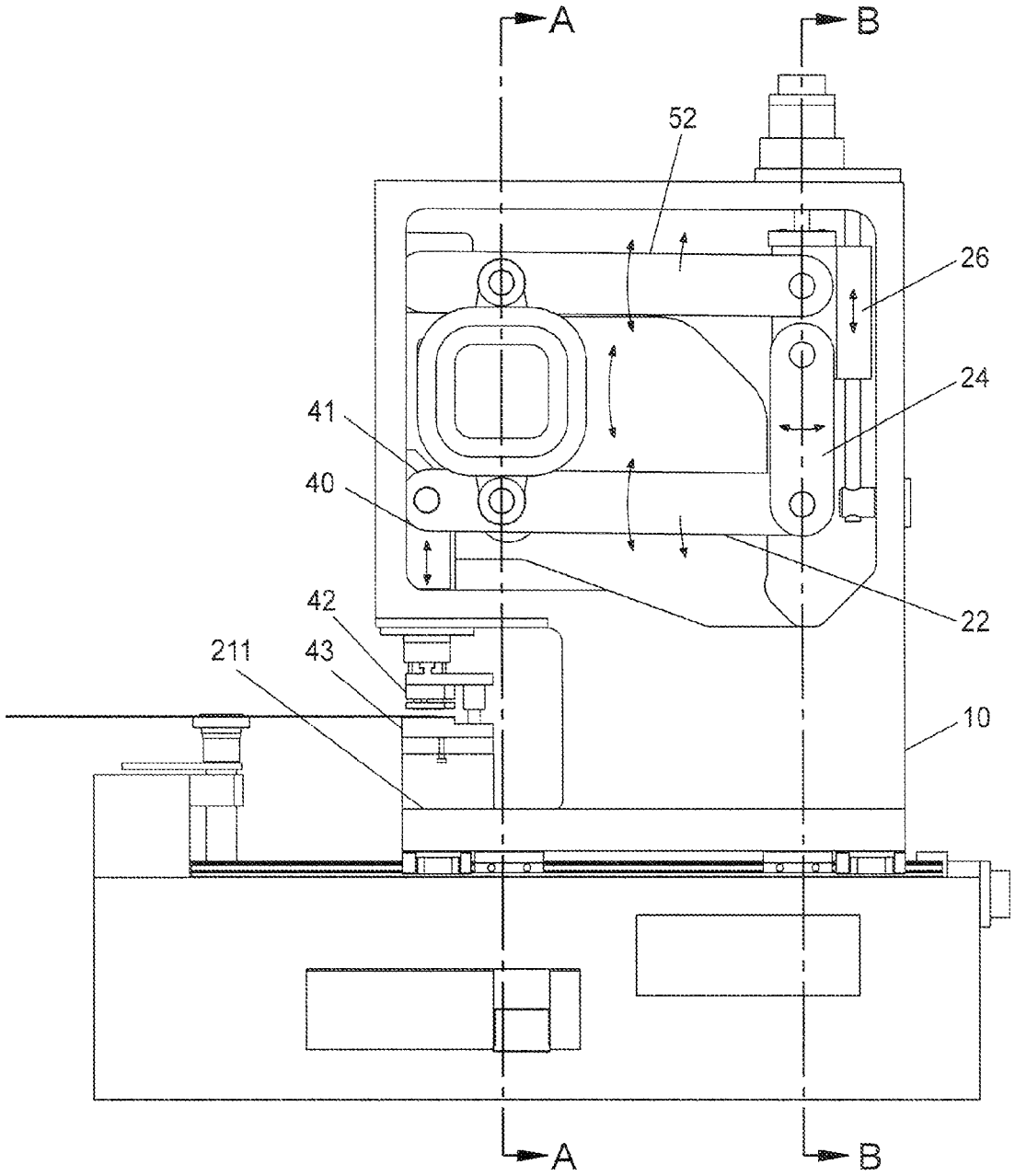
FIG. 5 is a side view of the notching press machine with the covers removed.
Figure 6:
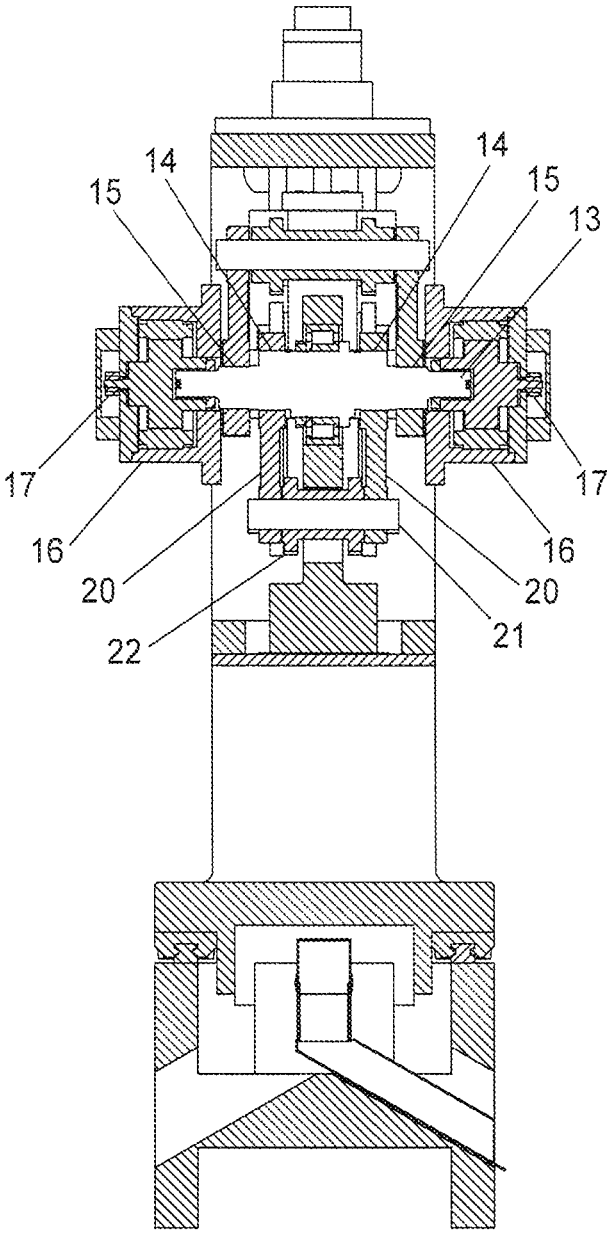
FIG. 6 is section A-A of FIG. 5.
Figure 7:
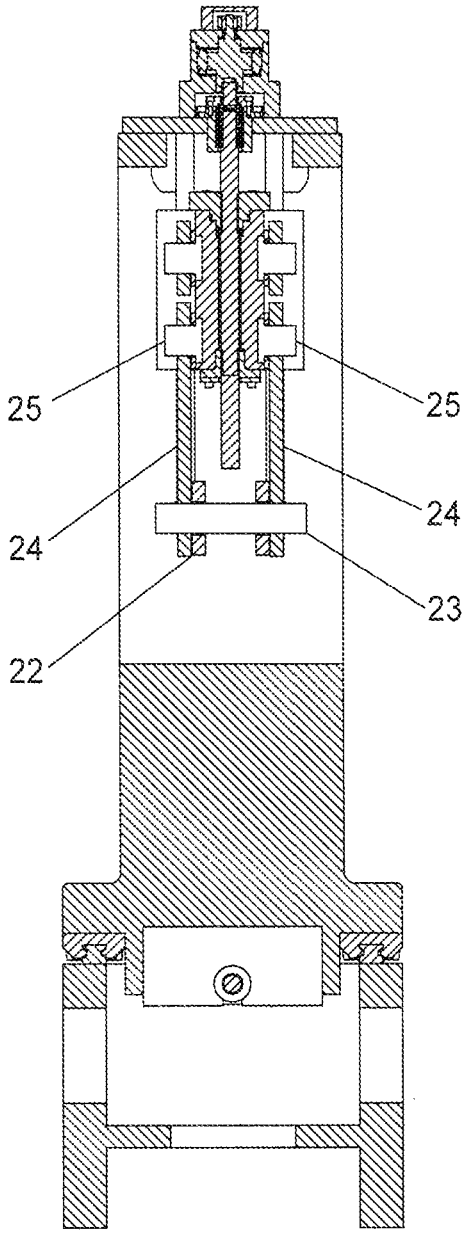
FIG. 7 is section B-B of FIG. 5.
Figure 8:
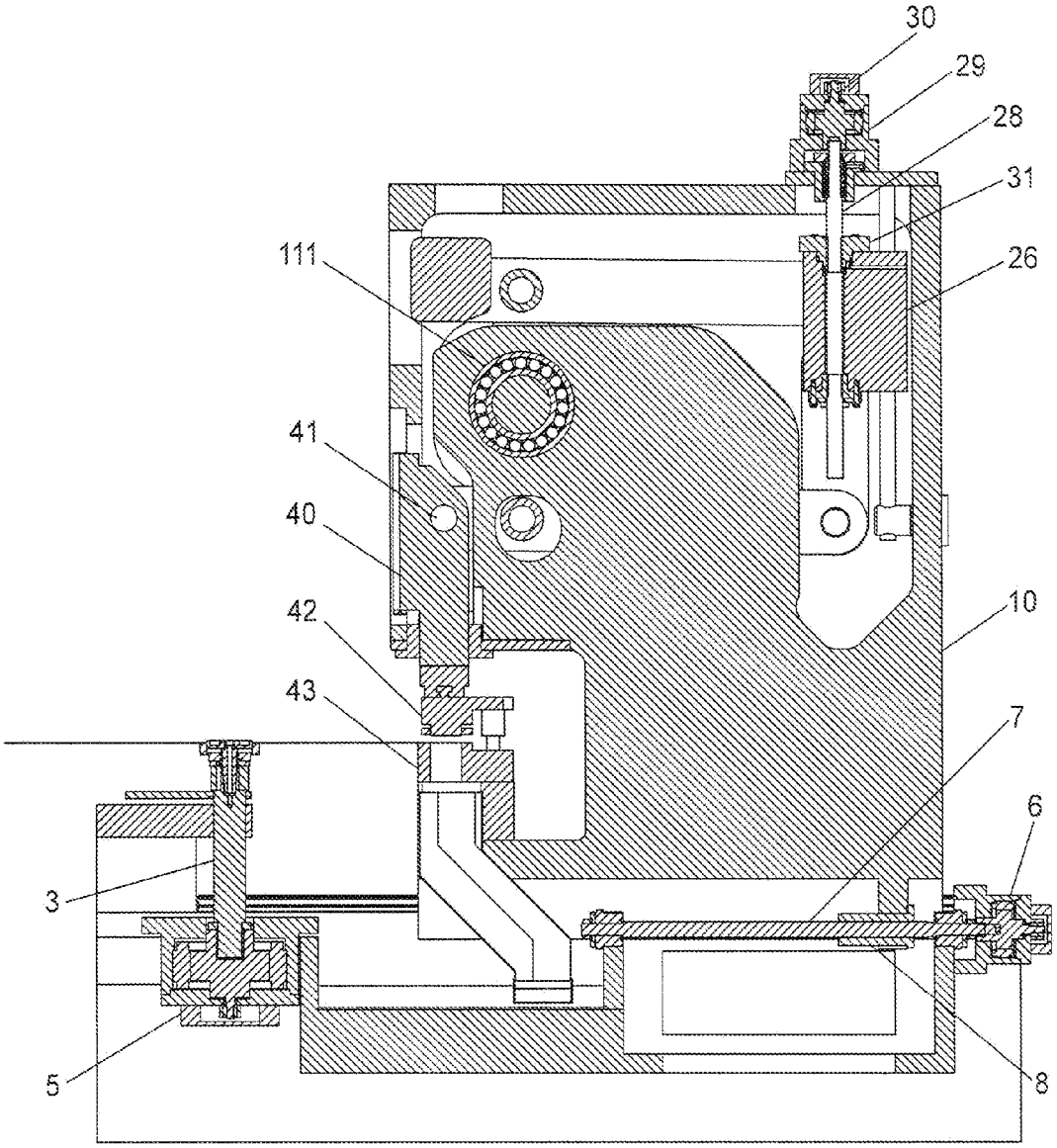
FIG. 8 is section C-C of FIG. 4.
Figure 9:
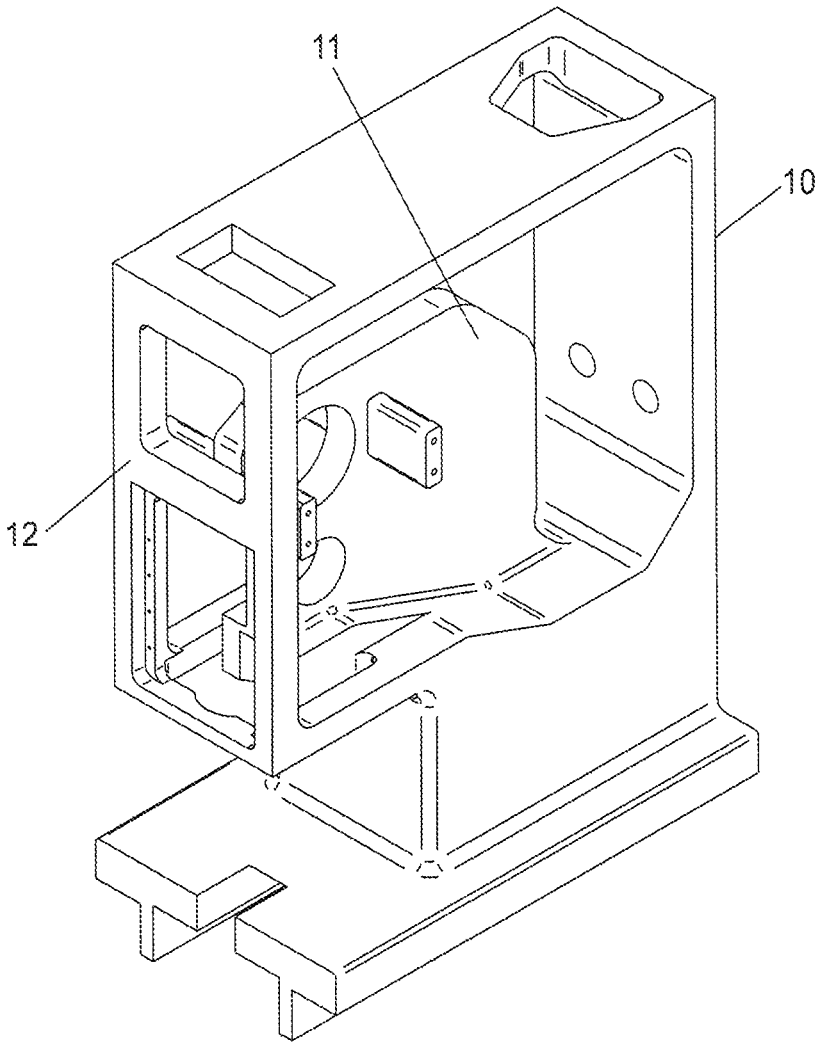
FIG. 9 is an isometric of the notching press machine press frame.
Figure 10:
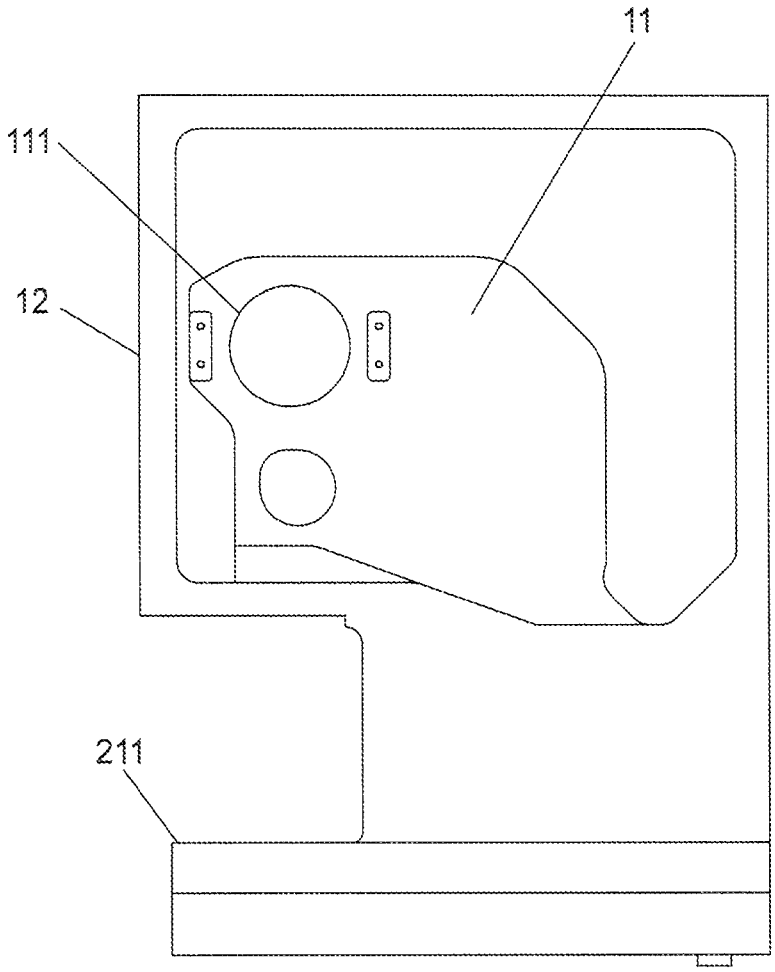
FIG. 10 is a side view of the notching press machine press frame.

In a re-tooling operation of the notching press machine an upper tool section 42 is fixed to the ram 40 (FIG. 8). A lower tool section 43 is fixed to the press frame 10 and in particular to the first section 11 of the press frame 10. Press positioning motor 6, screw 7 and nut 8 may be used to position gap frame press 2 into proper position relative to spindle 3 for the processing of a particular work piece. Drive motor(s) 16 is rotated such that first eccentric portion 14 of crankshaft 13 is positioned in the lowest or "shut" position. Ram adjustment motor 29 is then rotated and ram adjustment screw 28 and ram adjustment threaded nut member 31 cooperate to move support member 26 and secondary ram drive link(s) 24 in a direction substantially parallel to the direction of the ram guide(s) 44 (FIG. 3). Pivot pin 23, secondary ram drive link 24, main ram drive link 22, pivot pin 41, and pivot pin 21 cooperate to move upper tool section toward or away from the lower tool section depending upon the direction of rotation of ram adjustment motor 29. The shut height of the notching press machine may therefore be adapted to various tooling components. The position of ram adjustment motor 29 and the position of support member 26 may be measured and in the preferred embodiment stored in a controller for reference. This position of support member 26 corresponds to the closed working position or shut height of the ram 40. Drive motor(s) 16 is then rotated such that the first eccentric portion 14 of crankshaft 13 is positioned in the highest or open working position. Ram adjustment motor 29 is not moved during this rotation of crankshaft 13. It can be seen then that the closed and open working positions of ram 40 are thus determined by the position of support member 26 while the movement between the closed and open working positions of ram 40 is provided by the rotation of eccentric crankshaft 13. The adjustment of the closed and open working positions of ram 40 and in particular the ram shut height by the repositioning of support member 26 need only be adjusted once upon loading of a new tool.

Figure 11:
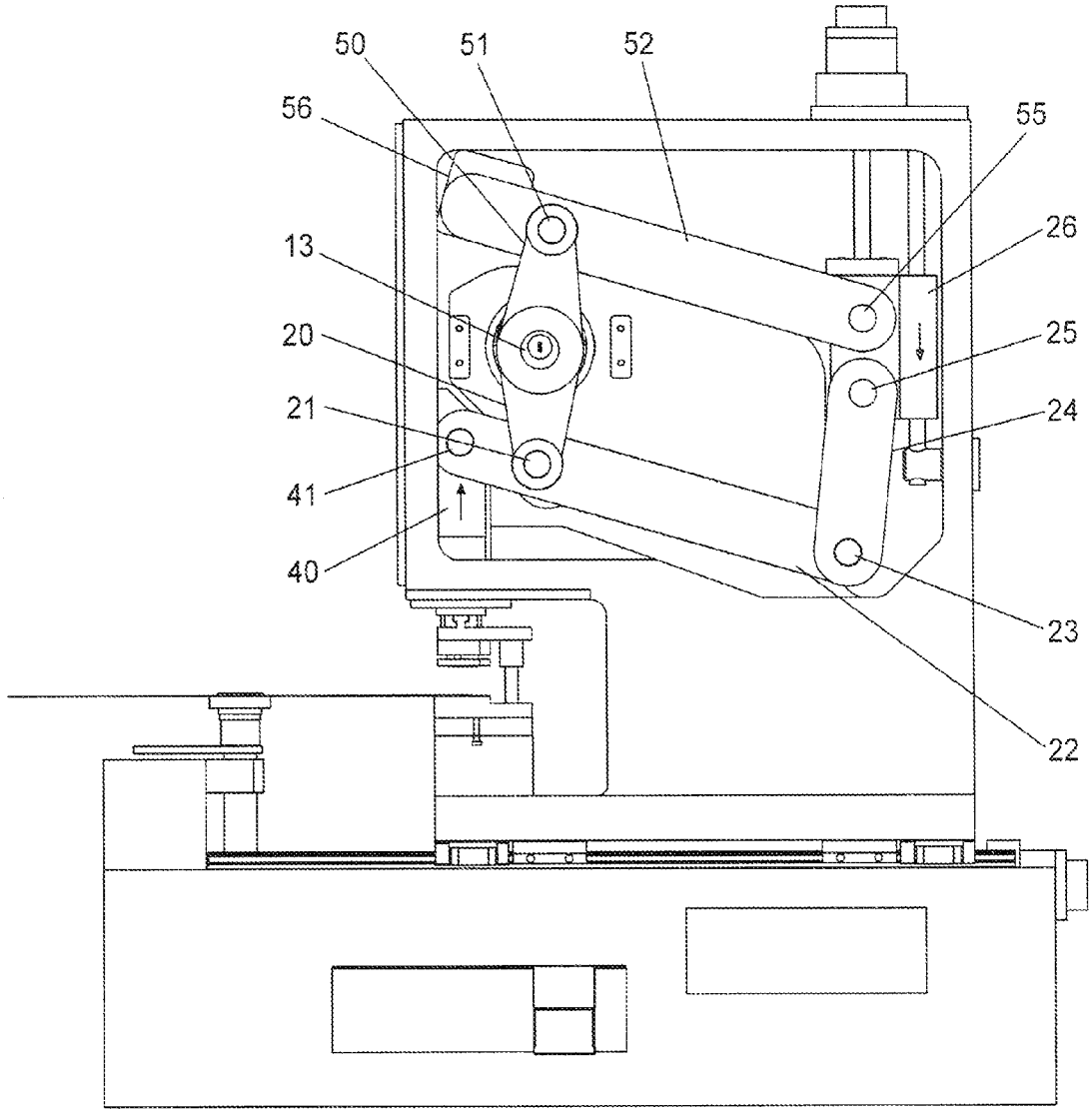
FIG. 11 is a side view of the notching press machine in a ram lifted position.

In a work piece processing operation of the improved notching press machine, ram adjustment motor 29 is rotated in a first direction and ram 40 lifted to a predetermined position above the open working position to facilitate work piece loading. The same components involved in adjusting the ram shut height as described in the proceeding discussion are utilized. When ram 40 has been raised to a predetermined position, work piece 4 may be inserted between upper tool section 42 and lower tool section 43. Ram adjustment motor 29 is now rotated in a second direction, opposite to the first direction, and ram 40 is lowered to the working open position, this position being determined as described previously. Work piece 4 is loaded onto spindle 3. Drive motors 16 and, via there driving connection thereto, crankshaft 13 is rotated. The linkage type ram drive mechanism transmits the motion of eccentric crankshaft 13 to effect a reciprocating motion of ram 40 and subsequently the upper tool section 42 into and out of working engagement of the lower tool section 43 and the work piece 4. During the time that the upper tool section 42 is out of working engagement with the lower tool section 43 and the work piece 4. By the motive driving torque of index motor 5, spindle 3 and work piece 4 are rotated and then stopped into a predetermined indexed position for the next working engagement of the upper tool 42 and the work piece 43. Crankshaft rotation and work piece indexing continue until work piece 4 is fully processed at which time drive motors 16 stop crankshaft 13 rotation, typically at the open working position. Ram adjustment motor 29 now rotates in the first direction and ram 40 is raised to a predetermined position above the open working position to facilitate the unloading of work piece 4 and the subsequent loading of a new work piece. The process may now be repeated. FIG. 11 depicts the notching press machine in a ram lifted position.

It should be noted that a further advantage of the ram adjustment mechanism described herein is full adjustability of the ram lifting function. It is desirable to minimize the ram lift amount to reduce the work piece processing cycle time. The ram lifting function of notching press machines known in the art are generally of fixed amount and therefore the time required to perform the ram lifting function cannot be improved. The ram adjustment mechanism described herein allows the predetermined position above the open working position to facilitate work piece loading may be freely adjusted to minimize the time required to perform this function.

The notching press machine further provides a mass counter balance system comprising a crankshaft 13 with first eccentric portion 14 and a second eccentric portion 15. Second eccentric portion 15 is arranged substantially opposite to, that is 180 degrees displaced from, first eccentric portion 14. The mass counter balance system is comprised of a main counterbalance drive link 52, a counterbalance drive connecting link 50, pivot pins 51 and 55, and a mass counterbalance 56. Main counterbalance drive link 52 is pivotally supported at a first end by pivot pin 55 for rotation thereabout. In the preferred embodiment depicted in the figures, pivot pin 55 is supported by ram adjustment mechanism support member 26, however this is only for convenience in the particular embodiment shown. Pivot pin 55 is supported to prevent translational movement during the processing of the work piece. As previously described, support member 26 remains stationary during work piece processing thereby preventing translational movement of pivot pin 55. However it will be obvious to one skilled in the art that pivot pin 55 may be supported by press frame 10 directly. Mass counterbalance 56 is fixedly mounted to main counterbalance drive link 52 at a second end. Counterbalance drive connecting link 50 is rotatable supported by the second eccentric portion 15 of crankshaft 13 at a first end. Counterbalance drive connecting link 50 is further pivotally connected at a second end of main counterbalance drive link 52 at a point between the first and second end of main counterbalance drive link 52 by pivot pin 51.

During rotation of crankshaft 13 and subsequent reciprocating motion of ram 40 and upper tool section 42, counterbalance drive connecting link 50, main counterbalance drive link 52, and pivot pins 51 and 55 cooperated to move mass counterbalance 56 in a reciprocating manner and in a direction substantially opposite the movement of press ram 40. While the movement of mass counterbalance 56 is not completely linear due to the rotating action of main counterbalance link 52 about translational fixed pivot pin 55, the predominate motion is in a direction opposite the motion of ram 40. The inertial forces of reciprocating mass counterbalance 56 offsets and reduces the shaking forced induced by the reciprocation motion of ram 40 and the upper tool section 42. Taking into account the geometries and masses involved, it is a simple matter to calculate the required mass counterbalance 56 necessary to minimize the resultant shaking forces and to thus minimize the vibrations transmitted to the base 1 of the improved notching press machine.

When upper tool section 42 comes into working engagement with work piece 4 and lower tool section 43, a first and second working force are generated due to the shearing or bending work completed on work piece 4. The first working forces is transmitted from the upper tool section 42 thru the linkage type ram drive mechanism to the press frame 10 and in particular to the first section 11 of press frame 10 at a first location 111. The second working force equal in magnitude and opposite in direction to the first working force is transmitted at the point where the lower tool section is fixed to press frame 10 and in particular to a second location 211 on the first section 11 of the press frame 10. The first and second working forces cooperate to generate a bending force or moment that is resisted by the first section 11 of the press frame 10 resulting in a displacement of first location 111 relative to second location 211. That is to say that the shape of first section 11 of press frame 10 will be distorted.

As previously described ram 40 is supported by press frame 10 and in particular by second section 12 of press frame 10 and arranged for sliding movement in a linear direction parallel to the rotational axis of indexing spindle 3 and being guided by ram guide(s) 44. Guiding of ram 40 is provided to ensure proper alignment of upper tool section 42 with lower tool section 43. Second section 12 of press frame 10 is arranged to prevent the distortion of the first section 11 of press frame 10 from being transmitted to the second section 12 of press frame 10. First section 11 and second section 12 are connected only in a limited manner and at an advantageous location so as to prevent the transmission of displacements or forces acting on first section 11 from effecting second section 12. The construction of the press frame in two sections thus functions to isolate the deflection or distortion of the first press frame section 11 from the second press frame section 12 which supports the linear guiding of the press ram. Guiding of the ram and alignment of the upper and lower tool sections is therefore improved and the effect of the stamping process on the guiding of the ram is reduced. The preferred embodiment of an improved press frame 10 of the notching press machine is depicted as a single component 10 with two sections 11 and 12, however press frame 10 may be constructed from separate components connected in a manner to provide the advantages described herein.

It should be noted that while gap frame press 2 is shown as a component of a notching press machine, the improved design of press frame 10, the mass counter balance system, the am adjustment mechanism, and the linkage type ram drive mechanism may be applicable to any press machine including gap frame and non-gap frame or straight side presses which are not part of a notching press machine.

Drive motors 16, index motor 5, press positioning motor 6, and ram adjustment motor 29 are preferably electric servo motors which preferably comprise feedback devices. The feedback devices of drive motors 16, index motor 5, press positioning motor 6, and ram adjustment motor 29 preferably communicate via electrical signals to a control system 57. The control system 57 further comprises power supply means to supply power to drive motors 16, index motor 5, press positioning motor 6 and ram adjustment motor 29. Such control systems are well known in the art and are therefore not detailed here.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A press machine comprising:

a press frame;

a ram;

a crankshaft rotatably supported by the press frame, wherein the crankshaft has an eccentric portion;

a linkage type ram drive mechanism operably connected between the ram and the crankshaft;

a first drive motor, with a first rotary position feedback device, said first motor connected to a first end of the crankshaft and driven to rotate said crankshaft from said first end; and a second drive motor, with a second rotary position feedback device, said second motor connected to a second end of the crankshaft and driven to rotate said crankshaft from said second end; and wherein the eccentric portion of the crankshaft is located between the first and second ends of the crankshaft.

2. The press machine of claim 1, further comprising;

a control device;

wherein the control device is configured to receive signals from said first and second rotary position feedback devices;

wherein the control device is configured to command the first drive motor, and wherein the control device is configured to command the second drive motor.

3. The press machine of claim 2, wherein the control device is configured to compare the rotary position feedback signals of the first and second rotary position feedback devices.

4. The press machine of claim 3, wherein the control device is configured to command a stoppage of the first drive motor in response to a detection of a difference between the rotary position feedback signal of the first rotary position feedback device and the rotary position feedback signal of the second rotary position feedback device.

5. The press machine of claim 3, wherein the control device is configured to command a stoppage of the second drive motor in response to a detection of a difference between the rotary position feedback signal of the first rotary position feedback device and the rotary position feedback signal of the second rotary position feedback device.

6. The press machine of claim 3, wherein the control device is configured to command a stoppage of the first or second drive motor in response to a detection of a failure of a component of the system.

7. The press machine of claim 6, wherein the failure of a component of the system is a breakage of the crankshaft.

8. The press machine of claim 6, wherein the failure of a component of the system is a failure of a feedback device.

9. The press machine of claim 6, wherein the failure of a component of the system is a disconnection of a drive motor from the crankshaft.

10. The press machine of claim 1, wherein the first and second drive motors are electric servo motors.

* * * * *